US005632205A

United States Patent [19]

Gordon et al.

[11] Patent Number: 5,632,205

[45] Date of Patent: May 27, 1997

[54] APPARATUS FOR THE SPATIAL ORIENTATION AND MANIPULATION OF A GAME BALL

[75] Inventors: Steven J. Gordon, Weston; Peter K. Mansfield, Concord, both of Mass.

[73] Assignee: Acushnet Company, Fairhaven, Mass.

[21] Appl. No.: 484,248

[22] Filed: Jun. 7, 1995

[51] Int. Cl.[6] ..... B41F 35/00

[52] U.S. Cl. ..... 101/483; 101/DIG. 36; 364/559

[58] Field of Search ..... 101/483, 485, 101/36, 37, 38.1, 39, 40, 40.1, DIG. 40; 356/347, 372, 375, 446; 250/222.1; 364/559; 395/155

[56] References Cited

U.S. PATENT DOCUMENTS

| | | | |
|---|---|---|---|
| 4,745,857 | 5/1988 | Putnam et al. | 101/44 |
| 4,796,201 | 1/1989 | Wake | 400/61 |
| 4,836,119 | 6/1989 | Siraco et al. | 112/475.02 |
| 4,844,947 | 7/1989 | Kasner et al. | 101/55 |
| 4,871,252 | 10/1989 | Beni et al. | 356/347 |
| 4,974,511 | 12/1990 | Hsi-Chou | 101/38.1 |
| 5,012,116 | 4/1991 | Russell | 356/446 |
| 5,227,985 | 7/1993 | DeMenthon | 364/559 |
| 5,319,577 | 6/1994 | Lee | 364/559 |
| 5,345,309 | 9/1994 | Wertz et al. | 356/372 |
| 5,389,476 | 2/1995 | Kruchko | 101/DIG. 36 |
| 5,479,008 | 12/1995 | Nishiyama et al. | 250/222.1 |
| 5,561,756 | 10/1996 | Miller et al. | 395/155 |

*Primary Examiner*—Eugene H. Eickholt
*Attorney, Agent, or Firm*—Pennie & Edmonds

[57] ABSTRACT

An apparatus for the spatial orientation of a spherical object comprising a camera for gathering an image of the spherical object and its spatial orientation, a computer communicating with the camera for processing the image and for computing a required spatial rotation to bring the spherical object into a desired spatial orientation, and motors communicating with the computer for rotating the spherical object to a desired orientation without substantially moving the center of the spherical object.

23 Claims, 4 Drawing Sheets

APPARATUS FOR THE SPATIAL ORIENTATION AND MANIPULATION OF A GAME BALL

BACKGROUND OF THE INVENTION

FIELD OF THE INVENTION

The present invention relates to an apparatus for orienting a spherical object, preferably a game ball, according to pre-existing visually recognizable indicia which appear on the surface of the spherical object, so that additional indicia may be made on the spherical object in a pre-determined orientation with respect to the pre-existing indicia.

DESCRIPTION OF THE PRIOR ART

A large and growing percentage of all golf balls manufactured require custom printing to add a logo of a particular resort or club to the surface of the ball. This process involves orienting the golf ball already imprinted with the ball manufacturer's standard identification and placing the ball to be imprinted in a ball holding fixture during the custom printing step. Currently golf balls are oriented and placed by hand. The process of picking up a ball, determining where the manufacturer's logo appears, determining what the spatial orientation of the ball must be for adding an additional custom logo, changing the spatial orientation of the ball, and then placing the ball to be imprinted in the fixture, is laborious and expensive. There is an unfulfilled need for an apparatus that will automatically perform the orienting steps that are currently done manually.

SUMMARY OF THE INVENTION

The present invention is directed to an apparatus for the spatial orientation of a game ball for customized printing thereon comprising; camera means for gathering an image of game ball and its spatial orientation; Computer means communicating with said camera means for receiving and processing the image and for computing a required spatial rotation to bring the game ball into a desired spatial orientation; and rotating means communicating with said computer means for rotating the game ball to a desired orientation without substantially moving the center of the game ball.

BRIEF DESCRIPTION OF THE DRAWINGS

The preferred embodiments of the present invention can be more fully understood by reviewing the attached detailed description and accompanying drawing figures wherein.

DETAILED DESCRIPTION OF THE INVENTION

The term "spherical object" is used throughout the disclosure of the present invention and is intended to encompass any generally spherical object including game balls, such as for example golf balls, ball bearings, marbles, etc. Spherical objects which have some type of surface deformation such as golf balls which have a dimpled surface, or soft balls, which have a threaded surface, can be used in the present invention.

The term "indicia" is used in this application. This term includes all patterns, marks, labels, logos, that are visually distinguishable by the human eye, or any electronic device, such as a CCD camera.

To reach any arbitrary spherical object orientation, a sequence of rotations will be required. Euler's Theorem states that given three mutually orthogonal (perpendicular) axes attached to the same reference frame, any rotational orientation may be achieved by rotating in sequence about three axes. A given axis may be repeated in the sequence but not without an intervening rotation about an alternate axis.

For the specific example of the ball orientation mechanism we can define three mutually perpendicular rotational axes as the horizontal axis parallel with the wheel axis (X-axis), the vertical axis (Y-axis) and an axis perpendicular to the X-Y plane (Z-axis). Since the mechanism of the present invention permits direct rotation about the X and Y axes, Euler's theorem makes it clear that it will be possible to arrive at any arbitrary orientation using a sequence of either X-Y-X or Y-X-Y rotations. These axes are reference axes, fixed in space, and in the embodiment below, are a horizontal axis and a vertical axis.

Figure 1A:
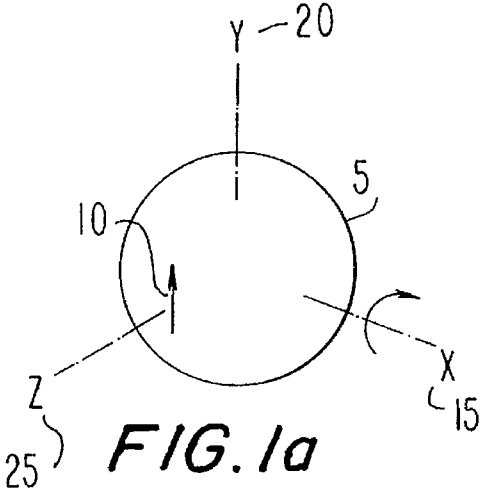
FIGS. 1*a–d* illustrate successive perspective views of a ball effectively rotated about the Z-axis by successive rotations about the X-axis and the Y-axis in accordance with the present invention;.
Figure 1B:
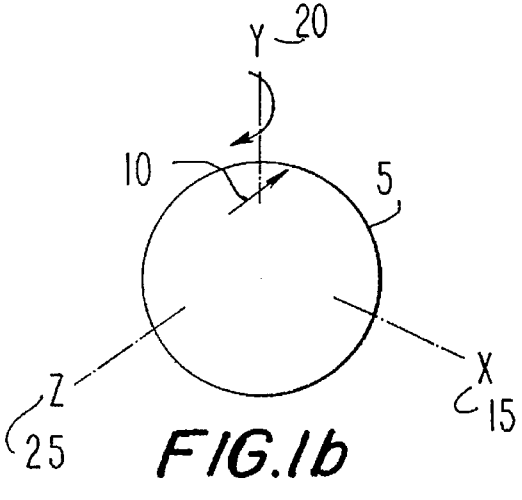
Figure 1C:
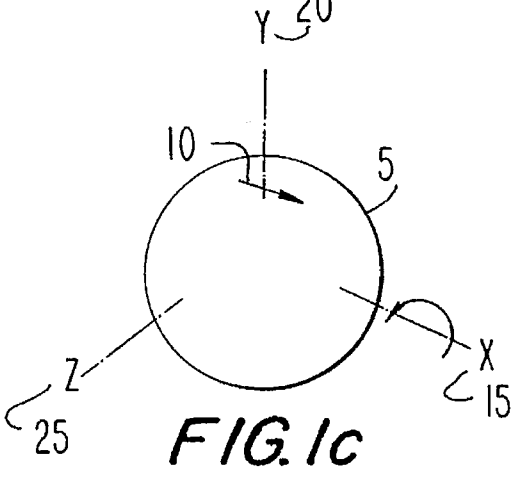
Figure 1D:
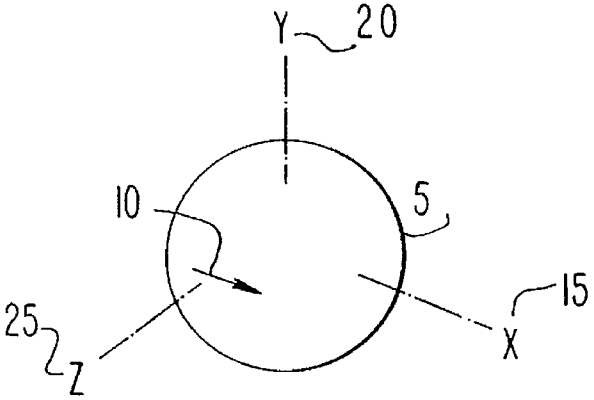

FIGS. 1*a–d* illustrate successive perspective views of a ball being rotated about the Z-axis in accordance with the present invention. The figures show how a ball can achieve an effective –90 degree rotation around a Z-axis by successive rotations about an orthogonal X and Y-axis, without the need for any direct rotation about the Z-axis itself. FIG. 1*a* shows a ball 5 with an arrow 10 marked on its surface in a first orientation. Orthogonal axes X, Y, and Z (items 15,20, 25, respectively) are indicated by extension lines extending from the surface of ball 5. The FIG. 1*a* ball is in a first rotational position, wherein arrow 10 is directed upwards. In this example, the desired rotational position is a 90 degree clockwise rotation about the Z-axis as seen looking inwardly toward the ball along the Z-axis. In FIG. 1*b*, the ball 5 has been rotated clockwise 90 degrees about the X-axis as seen looking inwardly toward the ball along the X-axis. This is indicated by the arrow's change in position from the side of the ball, intersecting the Z-axis, to the top of the ball intersecting the Y-axis. In FIG. 1*c*, ball 5 has been rotated clockwise 90 degrees about Y-axis as seen looking toward the ball along the Y-axis. In FIG. 1*d*, the first rotation about the X-axis has been reversed: ball 5 has been rotated counter-clockwise 90 degrees about the x-axis as seen looking toward the ball along the X-axis, returning the arrow to its original position at the intersection of the Z-axis and the surface of the ball. Comparing the change in arrow position between FIG. 1*a* and *d*, arrow 10 has now effectively rotated 90-degrees clockwise about the Z-axis, yet this was done by rotating the ball about the other orthogonal axes (X and Y) and not by rotating it about the z-axis directly.

Figure 2:
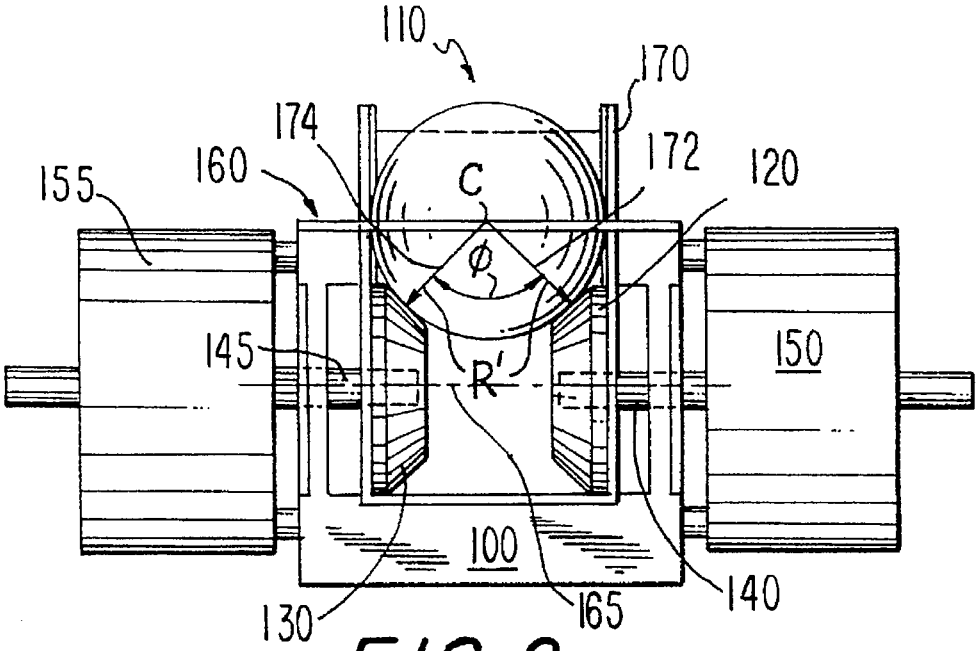
FIG. 2 illustrates a front view of one embodiment of the spherical object orientation and manipulation apparatus.

In FIG. 2, spherical object 110 is shown resting on movable supports 120, 130, which are preferably wheels as shown in this embodiment. These supports, when in contact with the spherical object and in motion, function to rotate the ball about its center C without translating center C. Other methods of rotating the spherical object may include devices such as elongated linear supports that translate longitudinally with respect to the spherical object, belts that translate with respect to the spherical object, and the like. Wheels 120,130 are mounted on rotating shafts 140,145, respectively, that extend from motors 150,155, respectively. As the wheels rotate in contact with the spherical object 110, each wheel has an instantaneous point of contact with the spherical object that does not move, but remains fixed with respect to the apparatus 100. Wheels 120,130 share the same axis of rotation 165 in this embodiment. Alternatively, the axis of rotation of wheels 120,130 may intersect at a single point. If the rotational axis is the same for both wheels, or if the axes of the wheels intersect at a single point, the instantaneous velocity of the wheels and the spherical object at the instantaneous point of contact between the wheels and the spherical object will be perpendicular to a plane defined by the two points of contact and the center of the spherical object C. By arranging the velocity vectors at the instantaneous points of contact to be parallel, slippage between the movable supports and the spherical object at the points of contact between the movable supports and the spherical object is minimized.

The wheels contact the surface of spherical object 110 at an angle $\phi$=90 degrees with respect to each other, the angle between one vector 172 extending from the center of the spherical object to the point at which wheel 120 and spherical object 110 touch, and vector 174, extending from the center of the spherical object to the point at which wheel 130 and spherical object 110 touch. While angle $\phi$ is shown as 90 degrees in this embodiment, a range of 15 degrees to 165 degrees is preferred, and a range of 40 degrees to 140 degrees is most preferred. If the angle is too small, the force required to rotate the spherical object about a vertical axis will be too large and the wheels will slip with regard to the spherical object. If, on the other hand, the angle is too large, the spherical object will slip when rotated about a horizontal axis. The surface of right and left wheels 120 and 130 may take any shape which will allow the rotation of the spherical object contacting the wheels about the center C of the spherical object. Such additional shapes include elliptical, patterned such as treaded, and preferably rounded. Motors 150,155 rotate wheels 120,130 by the rotation of shafts 140,145 respectively, about their longitudinal central axes. Motors 150,155 used in the present invention can be any motor capable of fulfilling the requirements of the present invention. However, for purposes of the present invention, a servo motor is preferred, since it allows for a great degree of control over position and velocity.

The position of spherical object 110 is changed by rotating wheels 120,130. Since the spherical object rests on wheels 120,130, and is fitted into a circular aperture 162 (shown in FIG. 3) having a diameter slightly larger than the outside diameter of spherical object 110, the spherical object will rotate with respect to apparatus 100, but will not translate. By varying the relative velocities of wheels 120, 130, the ball can be made to rotate about any axis lying in a plane containing the center of the spherical object 110 and the instantaneous points of contact of wheels 120,130 with spherical object 110. The particular axis in that plane about which spherical object 110 rotates at any point is determined by the relative velocities of the right and left wheels 120 and 130. Another feature of this apparatus is that when spherical object 110 is rotated, the center of the spherical object maintains approximately the same location by the effect of the dimensions of the aperture on the surface of the spherical object in combination with the fixed position of the supports during rotation of the sphere. The aperture, in combination with the movable supports prevent the center of the sphere from translating during rotation. The center is therefore fixed with respect to the camera shown in FIG. 4, below. As a result, the center is fixed with respect to a camera image processed by the computer, and therefore the computer need not recalculate the position of the center when it processes each successive image in order to determine the relative rotational position of the ball. A mirror 170 is positioned at one side of the aperture in the plate 160 holding the spherical object 110. The apparatus of FIG. 2 will permit independent rotations about two primary axes. When wheels 120 and 130 rotate at the same speed in the same direction, spherical object 110 rotates about an axis passing through the center of the ball and parallel to the wheel axis, which is horizontal in this embodiment. When wheels 120 and 130 rotate at the same speed in opposite directions, the ball will rotate about an axis passing through the center of the ball and perpendicular to the wheel axis, which is vertical in this embodiment. These two axes are at right angles or orthogonal. Thus, the apparatus provides for rotation about two orthogonal axes passing through the center of the ball as shown in FIGS. 1*a–d*, which, as explained above, will allow the spherical object to move from any first arbitrarily chosen orientation to any second arbitrarily chosen orientation. In addition, the spherical object may be rotated about any axis that lies in the plane defined by the primary axes by applying different speeds to each wheel. Thus, for movable supports capable of moving at different speeds and in the same and opposing directions with respect to each other, the ball may be rotated about any axis located in a plane intersecting the center C of the spherical object and the two points of contact.

The motors shown in FIG. 2 are connected to wheels of the same diameter. Alternatively, the wheels could have different diameters, in which case the motor shafts or wheels, rather than share a common rotational axis, would be offset with regard to each other, preferably with rotational axes that intersect, more preferably with rotational axes that are parallel, but offset with regard to each other.

In the FIG. 2 embodiment, a label or other indicia located anywhere on the surface of the spherical object can be positioned at the uppermost point of the spherical object in the proper position for printing in the following manner: (a) the motors are energized and the wheels rotated in opposing directions at the same speed, causing the spherical object to rotate about its vertical axis, (b) the indicia is thereby rotated about the spherical object's vertical axis until the indicia intersects a plane passing through the center of the spherical object, parallel to an instantaneous velocity vector measured at a point of contact of the spherical object and the wheels, and including the axis about which the spherical object is rotated, in this case, the vertical axis, (c) the motors are then energized and the wheels rotated in the same direction, causing the spherical object to rotate about a horizontal axis, so parallel to the axes of the motors, (d) the indicia is thereby rotated upwards until it reaches the top of the spherical object, intersecting the vertical axis of the spherical object, (e) the motors then run in opposing directions, causing the spherical object to again rotate about its vertical axis, (f) the indicia (now located at the top of the spherical object) rotates about its center until it reaches the proper orientation for printing. At this point, the custom indicia can be stamped on the spherical object.

Three rotations, therefore, about three axes, each orthogonal to the preceding one, can move an indicia located on the surface of the spherical object in any position or orientation, to another predefined position for printing.

Figure 3:
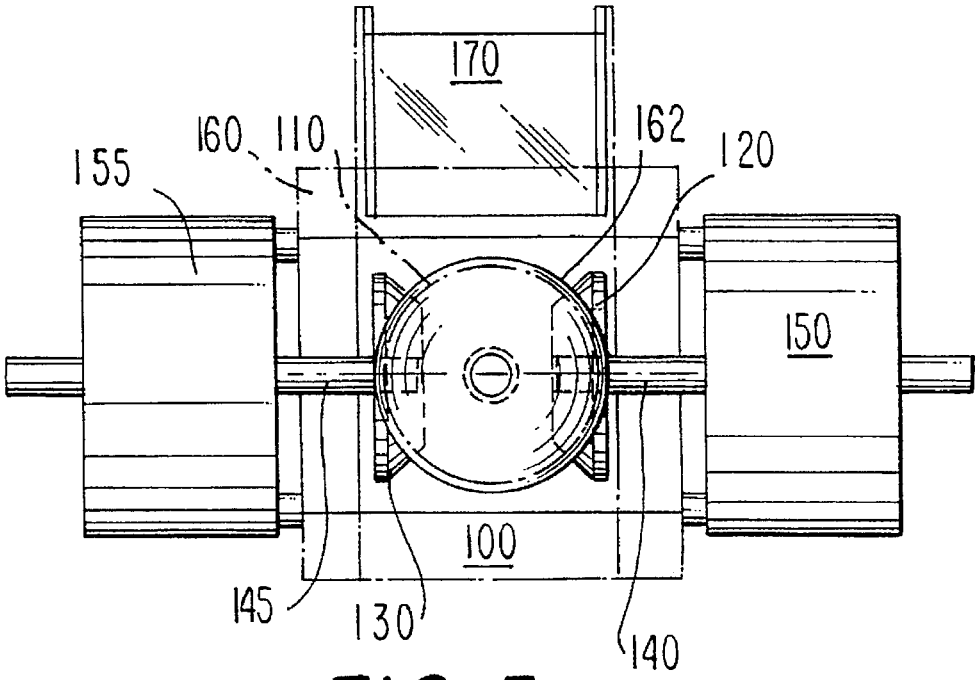
FIG. 3 illustrates a top view of one embodiment of the spherical object orientation and manipulation apparatus.

As shown in FIG. 3, aperture 162 is circular, and has a diameter slightly larger than the diameter of spherical object 110, the outline of which is here shown as dashed line 110.

This aperture supports the surface of spherical object at least two points, and functions to prevent the center of the spherical object from translating with respect to the apparatus when wheels 120,130 rotate about their axes and cause the spherical object to rotate.

Figure 4:
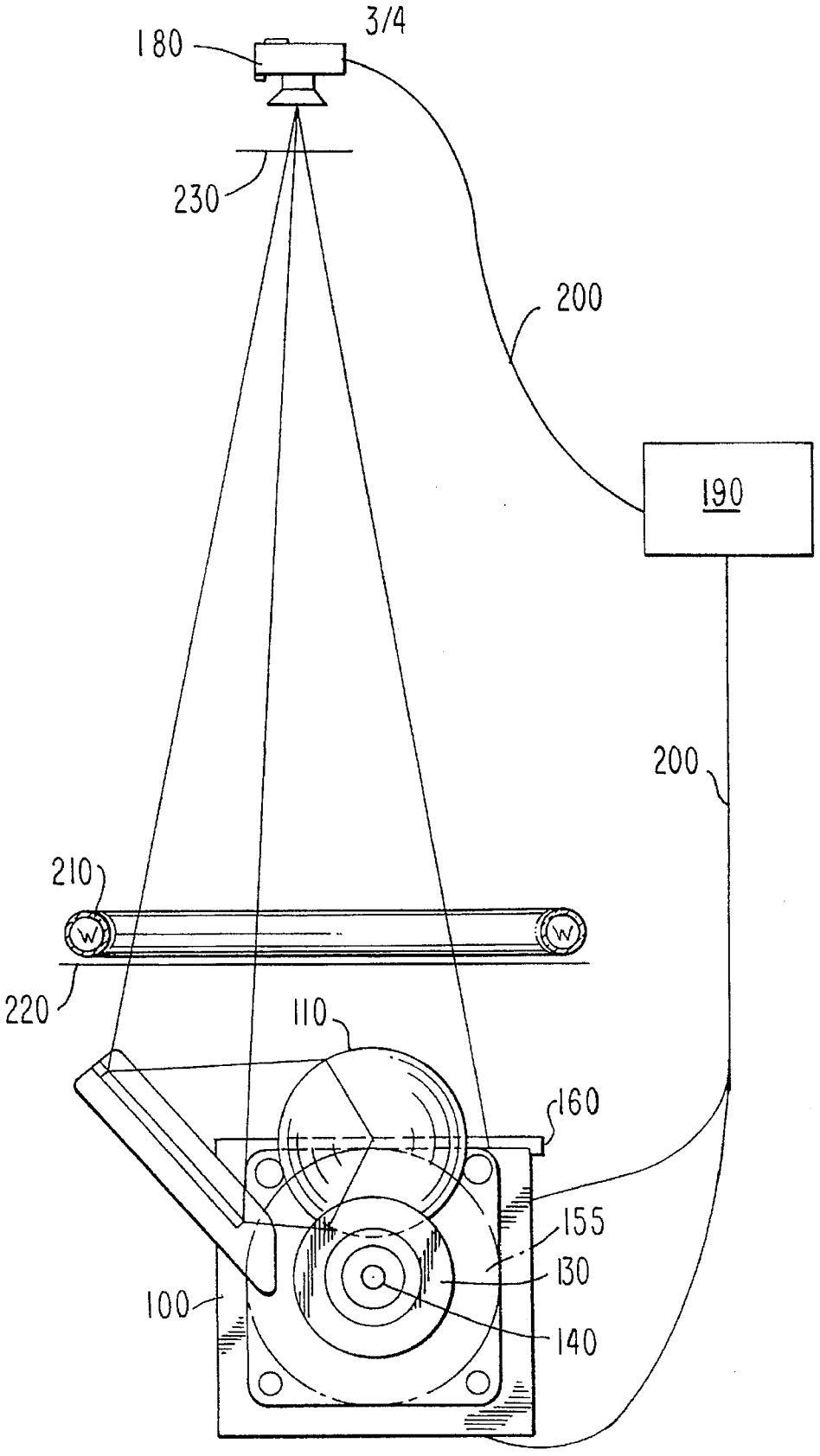
FIG. 4 illustrates a side view of one embodiment of the spherical object orientation and manipulation apparatus.

In FIG. 4, the angular relationship of mirror 170 of spherical object orientation and manipulation apparatus 100 with spherical object 110 and camera 180 can be seen. Mirror 170 is preferably positioned at 45° to axis of the camera 180 to permit the camera 180 to view a greater surface area of the spherical object at any orientation. Without the mirror, the camera can only view slightly less than a single hemisphere of the spherical object at one time. With an additional mirror, the camera can view more than this hemisphere. When the mirror is arranged such that both the mirror and the spherical object are in the field of view of the camera, as shown here, more than a single hemispherical view of the spherical object can be gathered in a single image frame. A second mirror in a similar angular orientation to camera 180 can be mounted on the opposite side of the spherical object 110 to provide even greater visibility to the camera. By providing mirrors, rather than separate cameras, the cost of the system is reduced, as is the need to keep two cameras in proper spatial orientation. Furthermore, the system is able to rotate the spherical objects to the predetermined position more rapidly. With a larger viewable surface area, it is more likely that the indicia preprinted on the surface of the spherical object will be seen by the camera when it is first placed in the apparatus. If it cannot be seen when the spherical object is placed in the apparatus, an initial step is required to rotate the spherical object until the pre-printed indicia can be seen by the camera and the proper rotations calculated.

Although this embodiment illustrates a single mirror application, it would be preferable to have more mirrors, preferably four mirrors positioned to show substantially all the surface of the spherical object in a single view.

A light source 210 is oriented between camera 180 and spherical object 110 to provide even lighting for spherical object 110. This source is preferably a ring-type light source, as shown, which will evenly illuminate the spherical object from all sides. To reduce specular glare, a polarizing filter 220 is oriented between light source 210 and spherical object 110. Another polarizing filter 230 is located between camera 180 and spherical object 110. The filters are oriented with respect to each other such that light specularly reflected from the surface of the spherical object is substantially eliminated, and light diffusely reflected from the surface is substantially passed through the filter.

A computer 190 is electrically connected to camera 180, and receives images from camera 180. The computer manipulates and measures the images to determine the presence and position of logos on the surface of the spherical object. Computer 190 is also electrically connected to motors 150,155 and controls their rotation. Computer 190 is preferably any computer capable of processing the images received from camera 180 and capable of controlling motors 150,155. In this case, an IBM-PC compatible 486 computer combined with a Sharp GPB-1 imaging system. Camera 180 can be any camera which will accomplish the goals of the present invention, preferably a small CCD camera. The electrical connection means 200 for transmitting data between the motors, the camera and the computer may be any connection means known to the person of ordinary skill in the art for connecting computer components, motors, and cameras.

To position the spherical object in the proper position for printing, the computer under program control: a) captures an image of the golf ball, then binarizes and negates it (e.g. changes lighter features to black and darker features to white resulting in .a black golf ball with white areas where the indicia are); b) enlarges the image around the white spots to eliminate black areas within the indicia and to ensure that elements of a particular indicia are all connected; c) locates each white subpart in the image and computes its centroid and area; d) calculates the area moments for determining the orientation of elongated indicia if required; e) correlates area and relative position information with calibrated data to identify the particular indicia currently observed (if no indicia are observed then the spherical object can be rotated some fixed amount in an arbitrary direction to bring the indicia into view and the process started again by capturing a new image; f) fits the observed indicia with a previously defined map of indicia on the sphere; g) determines the spherical object's current orientation and computes the succession of spatial rotations required to reach the desired orientation; h) signals the motors to perform these rotations.

The particular surface indicia on the spherical object that are processed by the computer include the corporate logo, the ball number, and the compression/ball type stamp. Each of these indicia has either a unique size and shape.

Software capable of performing the above steps with some additional programming is available off the shelf, one example of which is available from Sharp Digital Information Products, Inc. under the title "GPB-1 Image Processing Functions".

It is anticipated that more than one rotation cycle may be required. Preferably, only from one to four rotation cycles will be required to rotate the spherical object to a desired orientation. As mentioned above, an indicia may not appear in the first camera image, or the first camera image may include an indicia that the computer cannot identify in its present orientation and must be rotated closer to the center of the camera image in order to clearly identify the indicia. Furthermore, the indicia found may not be sufficient to uniquely identify the current ball orientation. Consider the case of viewing the Titleist Tour Balata 100 golf ball. If the vision system identifies the Titleist logo and the ball number but has no other information, then the ball's current orientation can be only one of two possibilities (there are two identical logos on the ball). One way to reconcile this is to make a trial rotation of 90 degrees about an axis perpendicular to the long axis of the logo to determine if the "Tour Balata 100" indicia is present. One further rotation may still be necessary to determine whether or not sufficient information has been gathered to proceed to final orientation.

One or more mirrors positioned to reflect different simultaneous views of the ball into the camera can be used to accelerate the orientation process.

Figure 5:
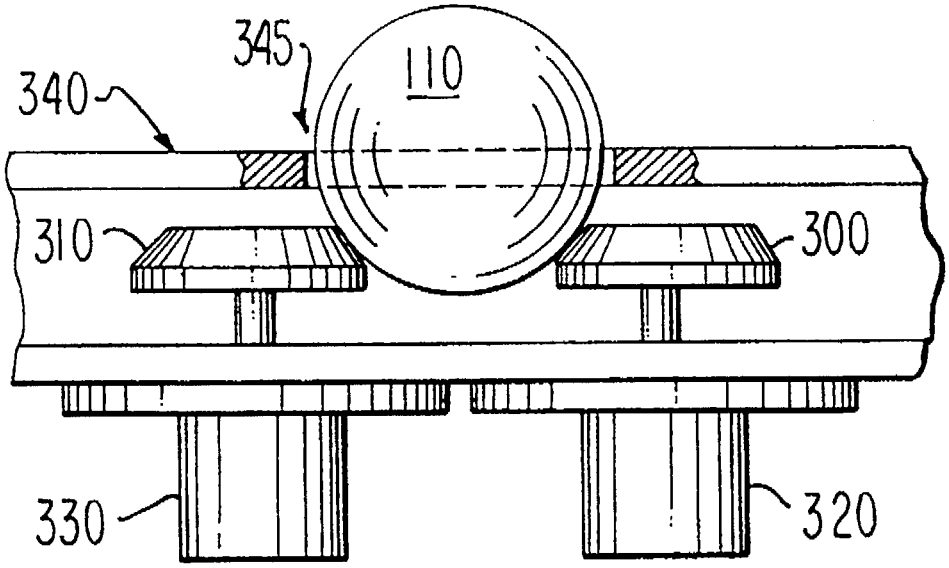
FIG. 5 illustrates a front view of another embodiment of the spherical object orientation and manipulation apparatus.

In the FIG. 5 embodiment of the present invention, motors 320 and 330 attached to wheels 300 and 310 for rotating spherical object 110. Motors 320,330 are not arranged such that their respective axes of rotation are defined along a common axis but are situated adjacent and parallel to each other. FIG. 5 also shows plate 340 having an aperture 345 (here shown partially cut away) for maintaining a substantially constant position for spherical object 110.

We claim:

1. An apparatus for the spatial orientation of a spherical object having a center comprising:

i) camera means for gathering an image of the spherical object and its spatial orientation;

ii) computer means communicating with said camera means for processing said image and for computing a required spatial rotation to bring said spherical object into a predetermined spatial orientation;

iii) rotating means contacting said spherical object at respective first and second points on an outer surface of said spherical object and communicating with said computer means for rotating said spherical object through said required spatial rotation to said predetermined spatial orientation without substantially moving said center of said spherical object.

2. An apparatus according to claim 1 which additionally comprises;

iv) a mirror situated to allow the camera means to gather an image of said spherical object that includes more than a single hemisphere of said spherical object.

3. An apparatus according to claim 1 wherein said means for rotating comprises first and second motors, said motors having respective first and second shafts.

4. An apparatus for the spatial orientation of a spherical object having a center comprising:

i) camera means for gathering an image of the spherical object and its spatial orientation;

ii) computer means communicating with said camera means for processing said image and for computing a required spatial rotation to bring said spherical object into a predetermined spatial orientation;

iii) rotating means comprising first and second motors, said motors having respective first and second shafts, and first and second wheels having respective first and second wheel rotational axes, attached to said respective first and second shafts, and wherein said first and second wheels contact said spherical object at respective first and second points on an outer surface of said spherical object, said rotating means communicating with said computer means for rotating said spherical object through said required spatial rotation to a predetermined orientation without substantially moving said center of said spherical object.

5. An apparatus according to claim 3 wherein said computer means electrically signal said first and second motors to rotate in the same direction at the same speed and in opposite directions at the same speed depending on the required spatial rotation.

6. An apparatus according to claim 4, wherein said first and second wheel rotational axes are parallel.

7. An apparatus according to claim 4, wherein said first and second wheel rotational axes intersect along a line.

8. An apparatus according to claim 4, wherein said first and second wheel rotational axes intersect at a point.

9. An apparatus according to claim 4 wherein an angle between said first and second points and having a vertex at a center of said spherical object is between 15 and 165 degrees.

10. An apparatus according to claim 4, wherein said angle is between 40 and 140 degrees.

11. An apparatus according to claim 4, wherein said angle is about 90 degrees.

12. An apparatus for the spatial orientation of a spherical object having a center comprising:

i) camera means for gathering an image of the spherical object and its spatial orientation;

ii) computer means communicating with said camera means for processing said image and for computing a required spatial rotation to bring said spherical object into a predetermined spatial orientation;

iii) rotating means communicating with said computer means for rotating said spherical object through said required spatial rotation to said predetermined spatial orientation without substantially moving said center of said spherical object; and iv) printer for printing one or more designs on said spherical object at a predetermined position relative to said predetermined spatial orientation.

13. A method for orienting and printing a second indicia upon a spherical object in a predetermined position with respect to first pre-existing indicia on said spherical object, said positioning comprising the steps of:

a) supporting said spherical object at a first and a second point of contact on a surface of said spherical object;

b) rotating said spherical object about a first axis passing through the center of said spherical object;

c) rotating said spherical object about a second axis passing through the center of said spherical object;

wherein said second axis is orthogonal to said first axis;

d) rotating said spherical object about a third axis passing through the center of said spherical object, wherein said third axis is orthogonal to said second axis; and e) printing said second indicia upon said spherical object at said predetermined position.

14. The method of claim 13, further comprising the step of stopping said rotating of said spherical object about said first axis when said first indicia intersects a plane passing through the center of said spherical object, parallel to an instantaneous velocity vector of said spherical object at said first point of contact, and including said first axis.

15. The method of claim 14, further comprising the step of stopping said rotating of said spherical object about said second axis when the first pre-existing indicia intersects said first axis of rotation.

16. The method of claim 15, wherein said first axis is oriented vertically.

17. The method of claim 16, wherein said second axis is oriented horizontally.

18. The method of claim 17, wherein said third axis and said first axis are parallel.

19. An apparatus for the spatial orientation of a spherical object having a center and printing on said object at a predetermined position relative to said spatial orientation, comprising:

i) camera means for gathering an image of an indicia on the spherical object and its spatial orientation;

ii) computer means communicating with said camera means for processing said image and for computing a required spatial rotation to bring said spherical object into a predetermined spatial orientation relative to said indicia;

iii) rotating means contacting said spherical object at respective first and second points on an outer surface of said spherical object for rotating said spherical object about a first axis and a second axis perpendicular to said first axis, said rotating means communicating with said computer means for rotating said spherical object through said required spatial rotation, first about said first axis, then about said second axis and then again about said first axis to bring said spherical object into said predetermined spacial orientation without substantially moving said center of said spherical object; and iv) a printer for printing one or more designs on said spherical object at said predetermined position.

20. An apparatus according to claim 19 wherein said means for rotating comprises first and second motors, having respective first and second shafts, and first and second wheels having respective first and second wheel rotational axes, attached to said respective first and second shafts; and wherein said first and second wheels contact said spherical object at said respective first and second points on an outer surface of said spherical object, and said first and second wheel rotational axes both extend along said second axis.

21. An apparatus according to claim 20 wherein said computer means electrically signal said first and second motors to rotate in opposite directions at the same speed to rotate said spherical object about said first axis and in the same direction at the same speed to rotate said spherical object about said second axis.

22. A method for orienting and printing a second indicia upon a spherical object in a predetermined position with respect to first pre-existing indicia on said spherical object, comprising the steps of:

a) supporting said spherical object at a first and a second point of contact on a surface of said spherical object;

b) rotating said spherical object about a first axis passing through the center of said spherical object;

c) rotating said spherical object about a second axis passing through the center of said spherical object; wherein said second axis is orthogonal to said first axis; and d) rotating said spherical object a second time about a said first axis to locate said predetermined position for printing; and e) printing said second indicia upon said spherical object at said predetermined position.

23. The method of claim 22, further comprising the steps of:

a) stopping said rotating of said spherical object about said first axis when a predetermined point relative to said first indicia intersects a plane passing through the center of said spherical object, parallel to an instantaneous velocity vector of said spherical object at said first point of contact, including said first axis;

b) stopping said rotating of said spherical object about said second axis when said predetermined point intersects said first axis of rotation; and c) stopping said second time rotation of said spherical object about said first axis when said predetermined position is located for printing.

* * * * *